US009297236B2

(12) United States Patent
Hånde

(10) Patent No.: US 9,297,236 B2
(45) Date of Patent: Mar. 29, 2016

(54) DEVICE FOR THERMALLY INSULATING ONE OR MORE ELEMENTS OF A SUBSEA INSTALLATION FROM AMBIENT COLD SEA WATER

(71) Applicant: VETCO GRAY SCANDINAVIA.AS, Sandvika (NO)

(72) Inventor: Olav Hånde, Hånde (NO)

(73) Assignee: Vetco Gray Scandinavia AS, Sandvika (NO)

( * ) Notice: Subject to any disclaimer, the term of this patent is extended or adjusted under 35 U.S.C. 154(b) by 0 days.

(21) Appl. No.: 14/225,726

(22) Filed: Mar. 26, 2014

(65) Prior Publication Data

US 2014/0290902 A1 Oct. 2, 2014

(30) Foreign Application Priority Data

Mar. 27, 2013 (NO) ..... 20130444

(51) Int. Cl.
*E21B 36/00* (2006.01)
*E21B 43/01* (2006.01)

(52) U.S. Cl.
CPC ..... *E21B 36/003* (2013.01); *E21B 43/01* (2013.01)

(58) Field of Classification Search
CPC ..... E21B 36/003; E21B 43/01
USPC ..... 166/335, 302, 304, 57, 61; 165/10, 902, 165/909
See application file for complete search history.

(56) References Cited

U.S. PATENT DOCUMENTS

| | | | | |
|---|---|---|---|---|
| 3,880,236 | A | 4/1975 | Durning et al. | |
| 4,679,598 | A * | 7/1987 | Jee | 138/103 |
| 6,756,021 | B2 * | 6/2004 | Botrel | 422/184.1 |
| 6,889,770 | B2 * | 5/2005 | Qvam et al. | 166/356 |
| 6,939,082 | B1 * | 9/2005 | Baugh | 405/145 |
| 7,367,398 | B2 * | 5/2008 | Chiesa et al. | 166/302 |
| 8,006,763 | B2 * | 8/2011 | Bath et al. | 166/338 |

(Continued)

FOREIGN PATENT DOCUMENTS

| | | | |
|---|---|---|---|
| GB | 2172683 | A | 9/1986 |
| WO | 0163088 | A1 | 8/2001 |

(Continued)

OTHER PUBLICATIONS

Norwegian Office Action dated Oct. 25, 2013 which was issued in connection with Norwegian Patent Application No. 20130444 which was filed on Mar. 27, 2013.

(Continued)

*Primary Examiner* — Matthew R Buck
(74) *Attorney, Agent, or Firm* — GE Global Patent Operation

(57) ABSTRACT

A device for thermally insulating at least one element of a subsea installation from ambient cold sea water, the device comprising an external casing which encloses an internal fluid chamber. The fluid chamber accommodates a fluid having heat-storing capacity, the element being received in the fluid chamber with the fluid surrounding the element so as to allow the fluid to delay cooling of the element by means of heat stored in the fluid. A heat storing member is mounted in the fluid chamber so as to be surrounded by the fluid. The heat storing member contains a medium having heat-storing capacity so as to allow transfer of heat from the fluid to the medium in the heat storing and vice versa to thereby allow the heat storing member to delay cooling of the fluid by means of heat stored in the medium in the heat storing member.

18 Claims, 1 Drawing Sheet

(56) References Cited

U.S. PATENT DOCUMENTS

| | | | | |
|---|---|---|---|---|
| 8,267,166 | B2 * | 9/2012 | Damsleth | E12B 36/003 165/181 |
| 8,424,608 | B1 * | 4/2013 | Lugo et al. | 166/357 |
| 8,701,713 | B2 * | 4/2014 | Bigex et al. | 138/33 |
| 2008/0063478 | A1 * | 3/2008 | Reddy | 405/154.1 |
| 2010/0051279 | A1 * | 3/2010 | Baugh et al. | 166/302 |
| 2010/0139924 | A1 * | 6/2010 | Abney | 166/335 |
| 2010/0200237 | A1 | 8/2010 | Colgate et al. | |
| 2012/0073823 | A1 * | 3/2012 | McClanahan et al. | 166/344 |
| 2012/0152517 | A1 | 6/2012 | Bruce et al. | |
| 2012/0241165 | A1 | 9/2012 | Cupolillo et al. | |

FOREIGN PATENT DOCUMENTS

| | | | |
|---|---|---|---|
| WO | 0212776 | A1 | 2/2002 |
| WO | 03006871 | A1 | 1/2003 |
| WO | 2006106406 | A1 | 10/2006 |

OTHER PUBLICATIONS

International Search Report issued in connection with corresponding Application No. GB1405395.3 on Sep. 4, 2014.

* cited by examiner

DEVICE FOR THERMALLY INSULATING ONE OR MORE ELEMENTS OF A SUBSEA INSTALLATION FROM AMBIENT COLD SEA WATER

BACKGROUND OF THE INVENTION

The present invention relates to a device for thermally insulating one or more elements of a subsea installation from ambient cold sea water.

In connection with oil and gas producing installations it is well known that cooling of the production fluid and high fluid pressure may result in the formation of hydrates, which may cause clogging of pipes and pipe connections. Cooling of the production fluid may be caused by ambient cold sea water, particularly during a temporary interruption of the production. To delay cooling of the production fluid in case of an interruption of the production, some form of thermal insulation and heat storage medium has to be provided to the element through which the production fluid flows. The element could for instance be a pipe, a manifold, a valve, a connector etc. WO 01/63088 A1 and WO 2006/106406 A1 disclose the use of a so-called heat bank for thermally insulating an element included in a subsea installation. The heat bank comprises a casing, which is arranged to enclose a fluid having heat-storing capacity, for instance water, and which has an internal space for receiving the element and the fluid with the fluid surrounding the element so as to allow the fluid to delay cooling of the element by means of heat stored in the fluid. The casing and the fluid enclosed therein form a thermal barrier between the element and the ambient sea water on the outside of the casing. By means of heat stored in the fluid inside the casing, the heat bank protects the element from cooling too rapidly. The fluid in the heat bank is heated by heat emitted from the protected element during normal operation. This heat emanates from the production fluid flowing through the element. If the heat input to the protected element from the production fluid is decreased or interrupted for some reason, the heat stored in the fluid inside the casing will slow down the cooling of the protected element caused by the ambient cold sea water on the outside of the casing.

SUMMARY OF THE INVENTION

Embodiments of the present invention achieve a further development of a device of the above-mentioned type for thermally insulating one or more elements of a subsea installation from ambient cold sea water, so as to provide a device that is improved in at least one way.

According to an embodiment, there is provided a device. The device comprises: an external casing which encloses an internal fluid chamber, wherein this fluid chamber accommodates a fluid having heat-storing capacity, the element or elements to be thermally insulated being received in the fluid chamber with the fluid surrounding the element or elements so as to allow the fluid to delay cooling of the element or elements by means of heat stored in the fluid; and at least one heat storing member mounted in the fluid chamber so as to be surrounded by the fluid accommodated in the fluid chamber, the heat storing member containing a medium having heat-storing capacity so as to allow transfer of heat from the fluid surrounding the heat storing member to the medium in the heat storing member when the temperature of the medium in the heat storing member is lower than the temperature of the fluid surrounding the heat storing member, and transfer of heat from the medium in the heat storing member to the fluid surrounding the heat storing member when the temperature of the medium in the heat storing member is higher than the temperature of the fluid surrounding the heat storing member to thereby allow the heat storing member to delay cooling of the fluid by means of heat stored in the medium in the heat storing member.

The heat storing member is separated from the external casing by the fluid occupying the space in the internal fluid chamber between the heat storing member and the external casing, and heat transfer directly from the heat storing member to the external casing is thereby prevented. When the heat input to the protected element is decreased or interrupted, the cooling of the element will be delayed by a two stage heat flow. As the fluid in the internal fluid chamber loses heat to the ambient sea water by heat transfer through the external casing, the fluid will receive heat from the medium contained in the heat storing member. The cooling of the fluid in the internal fluid chamber, and thereby the cooling of the protected element, is delayed by this transfer of heat from the medium contained in the heat storing member to the fluid in the fluid chamber.

Further advantages as well as advantageous optional features of the device according to the present invention will appear from the dependent claims and the following description. The various features of novelty which characterize the invention are pointed out with particularity in the claims annexed to and forming a part of this disclosure. For a better understanding of the invention, its operating advantages and benefits obtained by its uses, reference is made to the accompanying drawings and descriptive matter. The accompanying drawings are intended to show examples of the many forms of the invention. The drawings are not intended as showing the limits of all of the ways the invention can be made and used. Changes to and substitution of the various components of the invention can of course be made. The invention resides as well in sub-combinations and sub-systems of the elements described, and in methods of using them.

BRIEF DESCRIPTION OF THE DRAWINGS

With reference to the appended drawings, a specific description of embodiments of the present invention cited as examples follows below. In the drawings.

DETAILED DESCRIPTION OF THE EXEMPLARY EMBODIMENTS OF THE INVENTION

Figure 1:
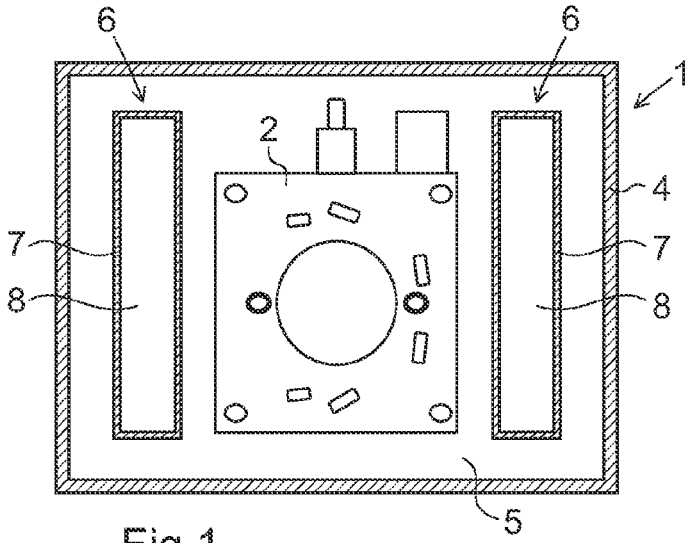
FIG. 1 is a schematic illustration of a device according to a first embodiment of the present invention, as seen in a longitudinal section.
Figure 2:
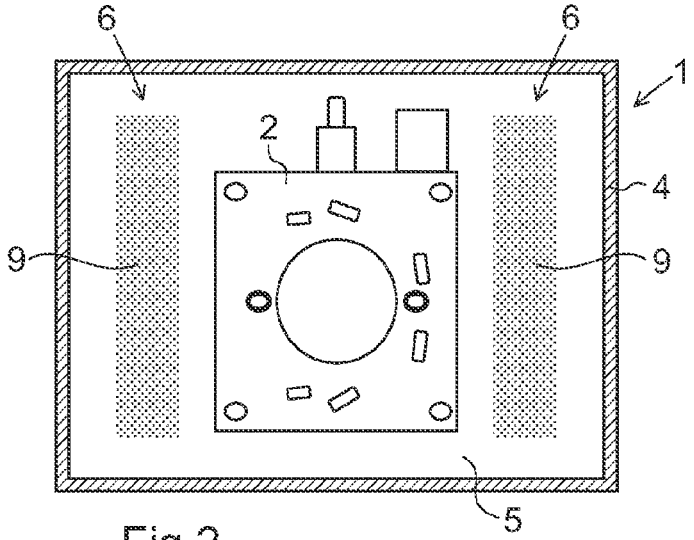
FIG. 2 is a schematic illustration of a device according to a second embodiment of the invention, as seen in a longitudinal section.
Figure 3:
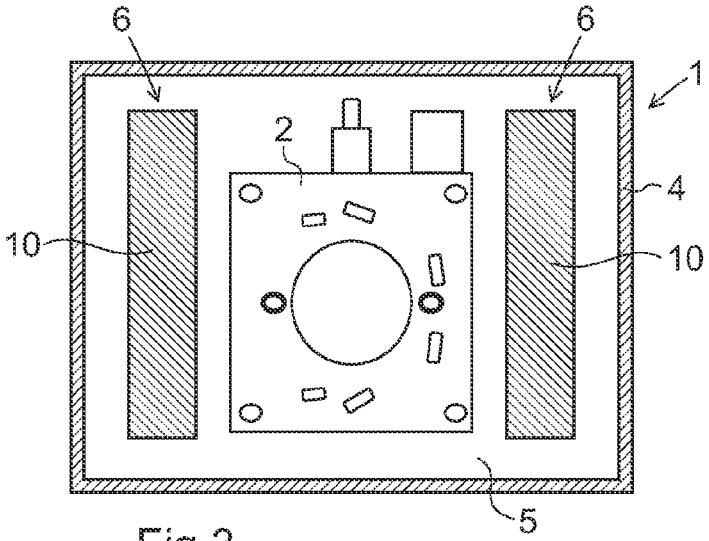
FIG. 3 is a schematic illustration of a device according to a third embodiment of the invention, as seen in a longitudinal section.

Different embodiments of a device 1 according to the present invention for thermally insulating one or more elements 2 of a subsea installation from ambient cold sea water are illustrated in FIGS. 1-3. The device 1 comprises an external casing 4 which encloses an internal fluid chamber 5. The casing 4 is of thermally insulating material and/or lined or coated with one or more layers of thermally insulating material. The casing 4 is for instance made of composite sandwich material, for instance with a syntactic epoxy foam core covered with a layer of epoxy fibreglass composite on each side. The casing 4 may for instance have a design of the type disclosed in WO 01/63088 A1 or any other suitable design. The device 1 is to be installed subsea with sea water surrounding the external casing 4. Thus, the outer side of the casing 4 is exposed to ambient sea water.

The fluid chamber 5 accommodates a fluid having heat-storing capacity, for instance water or any other suitable liquid. Thus, this fluid is enclosed by the casing 4 and thereby separated from the ambient sea water by the casing 4. The element or elements 2 are received in the fluid chamber 5 with the fluid surrounding the element or elements so as to allow the fluid to protect, by means of heat stored in the fluid, the element or elements from too rapid cooling.

At least one of the elements 2 received in the fluid chamber 5 is to be an element that emits heat during normal operation. This heat emitting element 2 could for instance be a pipe connector, a valve or a measuring device of a subsea oil and/or gas producing installation, wherein the element 2 is heated by production fluid flowing through the element. Consequently, the element 2 received in the fluid chamber 5 could for instance constitute a part of a subsea piping system for processing or transporting oil and/or gas.

In the embodiments illustrated in FIGS. 1-3, an element 2 in the form of a clamp connector is received in the fluid chamber 5 and surrounded by the fluid accommodated in the fluid chamber.

The casing 4 and the fluid enclosed therein form a thermal barrier between the element 2 and the ambient sea water on the outside of the casing. The fluid in the fluid chamber 5 is heated by heat emitted from the protected element 2 during normal operation. In the illustrated embodiments, this heat emanates from the production fluid flowing through the element 2. If the heat input to the element 2 from the production fluid is decreased or interrupted, the heat stored in the fluid in the fluid chamber 5 will delay the cooling of the element 2 caused by the ambient cold sea water on the outside of the casing 4.

At least one heat storing member 6 is mounted in the fluid chamber 5 so as to be surrounded by the fluid accommodated in the fluid chamber 5. In the illustrated embodiments, two such heat storing members 6 are mounted in the fluid chamber 5 on either side of the element 2. However, the device 1 may also be provided with only one heat storing member 6 or more than two heat storing members 6 inside the fluid chamber 5.

Each heat storing member 6 contains a medium having heat-storing capacity so as to allow transfer of heat from the fluid surrounding the heat storing member 6 to the medium in the heat storing member when the temperature of the medium in the heat storing member 6 is lower than the temperature of the fluid surrounding the heat storing member, and transfer of heat from the medium in the heat storing member 6 to the fluid surrounding the heat storing member when the temperature of the medium in the heat storing member 6 is higher than the temperature of the fluid surrounding the heat storing member. During normal operation, when the element 2 is heated internally by the production fluid and thereby emits heat to the fluid in the fluid chamber 5, the medium in the heat storing members 6 is heated to essentially the same temperature as the fluid in the fluid chamber 5. If the heat input to the element 2 from the production fluid is decreased or interrupted, the fluid in the fluid chamber 5 is gradually cooled by the ambient cold sea water on the outside of the casing 4 and the element 2 is thereby also gradually cooled. The cooling of the element 2 and the fluid in the fluid chamber 5 is delayed due to the heat input to the fluid from the heat stored in the medium in the heat storing members 6.

In the embodiment illustrated in FIG. 1, each heat storing member 6 comprises a receptacle 7 of heat-conducting material which accommodates the medium. The receptacle 7 is for instance formed of solid epoxy fibreglass panels. The heat-storing medium is received in an internal space 8 of the receptacle 7 and is separated from the fluid in the fluid chamber 5 by the external walls of the receptacle. The medium inside the receptacle 7 is more particularly a liquid, for instance water or any other suitable liquid. The medium inside the receptacle 7 may be the same as the fluid in the fluid chamber 5 or different from the fluid in the fluid chamber 5. If the medium inside the receptacle 7 is different from the fluid in the fluid chamber 5, the receptacle 7 has to be a closed receptacle that keeps the medium completely confined inside the receptacle. The receptacle 7 is mounted inside the casing 4 in such a manner that it is thermally insulated from the casing 4 so as to prevent conduction of heat directly from the receptacle 7 to the casing 4. Heat transfer from the fluid in the fluid chamber 5 to the medium in the internal space 8 of the receptacle 7, or vice versa, takes place through the external walls of the receptacle 7.

In the embodiment illustrated in FIG. 2, each heat storing member 6 comprises a body 9 of porous material which is soaked with the heat-storing medium, no wall being provided between the body 9 and the fluid surrounding the heat storing member 6. In this case, the medium in the heat storing member 6 is the same as the fluid in the fluid chamber 5 and is kept essentially stagnant inside the porous body 9. The natural convection of the fluid within the casing 4 is restricted due to the fact that a part of the fluid is kept essentially stagnant in the body 9, and the transfer of heat from the fluid to the ambient sea water on the outside of the casing 4 is thereby slowed down. The porous material of the body 9 may for instance be low density open cell polymer foam or low density felt made from polymer fibres, such as PET (polyethylene teraphtalate) or PP (polypropylene) fibres.

In the embodiment illustrated in FIG. 3, each heat storing member 6 comprises a solid body 10 formed by the heat-storing medium. The body 10 may be separated from the fluid in the fluid chamber 5 by an outer casing which encloses the body 10. As an alternative, the body 10 may lack an outer casing and be directly exposed to the fluid in the fluid chamber 5.

The invention is of course not in any way restricted to the embodiments described above. On the contrary, many possibilities to modifications thereof will be apparent to a person with ordinary skill in the art without departing from the basic idea of the invention such as defined in the appended claims.

While the present invention has been described with reference to the preferred embodiments, various changes or substitutions may be made to these embodiments by those of ordinary skill in the art pertinent to the present invention without departing from the technical scope of the present invention. Therefore, the technical scope of the present invention encompasses not only those embodiments described above, but all that fall within the scope of the appended claims.

The written description uses examples to disclosure the invention, including the best mode, and also to enable any person skilled in the art to practice the invention, including making and using any devices or systems and performing any incorporated processes. The patentable scope of the invention is defined by the claims, and may include other examples that occur to those skilled in the art. These other examples are intended to be within the scope of the claims if they have structural elements that do not differ from the literal language of the claims, or if they include equivalent structural elements with insubstantial differences from the literal languages of the claims.

What is claimed is:

1. A device for thermally insulating one or more elements of a subsea installation from ambient cold sea water, the device comprising:

an external casing enclosing an internal fluid chamber, wherein the internal fluid chamber accommodates a fluid having heat-storing capacity;

the one or more elements being received in the internal fluid chamber with the fluid surrounding the one or more elements so as to allow the fluid to delay cooling of the one or more elements by heat stored in the fluid; and at least one heat storing member is mounted in the internal fluid chamber so as to be surrounded by the fluid accommodated in the internal fluid chamber, the at least one heat storing member comprising a medium having heat-storing capacity, wherein the at least one heat storing member is configured to:

allow transfer of heat from the fluid surrounding the at least one heat storing member to the medium of the at least one heat storing member when the temperature of the medium of the at least one heat storing member is lower than the temperature of the fluid surrounding the at least one heat storing member;

store, in the at least one heat storing member, the transferred heat from the fluid surrounding the at least one heat storing member to the medium of the at least one heat storing member; and allow transfer of the stored heat from the medium of the at least one heat storing member to the fluid surrounding the at least one heat storing member when the temperature of the medium of the at least one heat storing member is higher than the temperature of the fluid surrounding the at least one heat storing member to thereby allow the at least one heat storing member to delay cooling of the fluid by the stored heat in the medium of the at least one heat storing member.

2. The device according to claim 1, wherein the medium having heat-storing capacity is contained in the at least one heat storing member.

3. The device according to claim 2, wherein the heat storing member comprises a receptacle of heat-conducting material configured to accommodate the medium.

4. The device according to claim 3, wherein the medium accommodated in the receptacle is a liquid.

5. The device according to claim 4, wherein the receptacle is thermally insulated from the external casing.

6. The device according to claim 1, wherein the at least one heat storing member comprises a body of porous material soaked with the medium.

7. The device according to claim 1, wherein the at least one heat storing member comprises a solid body formed by the medium.

8. The device according to claim 1, wherein two or more heat storing members of the at least one heat storing member are mounted in the internal fluid chamber so as to be surrounded by the fluid accommodated in the internal fluid chamber.

9. The device according to claim 1, wherein the external casing is of thermally insulating material and/or lined or coated with one or more layers of thermally insulating material.

10. A method for thermally insulating one or more elements of a subsea installation from ambient cold sea water, the method comprising:

enclosing an internal fluid chamber accommodating a fluid having heat-storing capacity in an external casing;

receiving the one or more elements in the internal fluid chamber with the fluid surrounding the one or more elements so as to allow the fluid to delay cooling of the one or more elements by heat stored in the fluid;

mounting at least one heat storing member in the internal fluid chamber so as to be surrounded by the fluid accommodated in the internal fluid chamber, the at least one heat storing member comprising a medium having heat-storing capacity;

allowing, by the at least one heat storing member, transfer of heat from the fluid surrounding the at least one heat storing member to the medium of the at least one heat storing member when the temperature of the medium of the at least one heat storing member is lower than the temperature of the fluid surrounding the at least one heat storing member;

storing, in the at least one heat storing member, the transferred heat from the fluid surrounding the at least one heat storing member to the medium of the at least one heat storing member; and allowing, by the at least one heat storing member, transfer of the stored heat from the medium of the at least one heat storing member to the fluid surrounding the at least one heat storing member when the temperature of the medium of the at least one heat storing member is higher than the temperature of the fluid surrounding the at least one heat storing member to thereby allow the at least one heat storing member to delay cooling of the fluid by the stored heat in the medium of the at least one heat storing member.

11. The method according to claim 10, wherein the medium having heat-storing capacity is contained in the one heat storing member.

12. The method according to claim 11, wherein the heat storing member comprises a receptacle of heat-conducting material configured to accommodate the medium.

13. The method according to claim 12, wherein the medium accommodated in the receptacle is a liquid.

14. The method according to claim 13, further comprising:

thermally insulating the receptacle from the external casing.

15. The method according to claim 10, wherein the at least one heat storing member comprises a body of porous material soaked with the medium.

16. The method according to claim 10, wherein the at least one heat storing member comprises a solid body formed by the medium.

17. The method according to claim 10, further comprising:

mounting two or more heat storing members of the at least one heat storing member in the internal fluid chamber so as to be surrounded by the fluid accommodated in the internal fluid chamber.

18. The method according to claim 10, wherein the external casing is of thermally insulating material and/or lined or coated with one or more layers of thermally insulating material.

* * * * *